US005720679A

United States Patent [19]

Schroeder

[11] Patent Number: 5,720,679

[45] Date of Patent: Feb. 24, 1998

[54] ADJUSTABLE BASKETBALL BACKBOARD SUPPORT SYSTEM

[75] Inventor: Edward A. Schroeder, Marengo, Ill.

[73] Assignee: Porter Athletic Equipment Company, Broadview, Ill.

[21] Appl. No.: 921,645

[22] Filed: Jul. 30, 1992

Related U.S. Application Data

[63] Continuation-in-part of Ser. No. 889,124, May 27, 1992, abandoned.

[51] Int. Cl.[6] ..... A63B 63/08

[52] U.S. Cl. ..... 473/484; 248/280.1; 248/281.1

[58] Field of Search ..... 273/1.5 R, 1.5 A; 248/280.1, 292.1, 281.1; 473/484

[56] References Cited

U.S. PATENT DOCUMENTS

| | | | |
|---|---|---|---|
| 278,797 | 6/1883 | Ide | 248/292.1 |
| 344,652 | 6/1886 | Hammerstein | 248/292.1 |
| 452,211 | 5/1891 | Cardarelli | 248/292.1 |
| 1,504,166 | 8/1924 | Thornley | 273/1.5 R |
| 2,313,188 | 3/1943 | Woodburn | 273/1.5 R |
| 2,881,003 | 4/1959 | Drew | 273/1.5 R |
| 2,986,395 | 5/1961 | Sheftel | 273/1.5 R |
| 3,341,197 | 9/1967 | Bottorff | 273/1.5 R |
| 3,427,025 | 2/1969 | Procter | 273/1.5 R |
| 3,586,324 | 6/1971 | Bearson | 273/1.5 R |
| 3,669,450 | 6/1972 | Mason | 273/1.5 R |
| 3,722,886 | 3/1973 | Sinner | 273/1.5 R |
| 3,765,676 | 10/1973 | Bearson et al. | 273/1.5 R |
| 4,145,044 | 3/1979 | Wilson et al. | 273/1.5 R |
| 4,330,101 | 5/1982 | Andersen | 273/1.5 R |
| 4,395,040 | 7/1983 | White | 273/1.5 R |
| 4,407,498 | 10/1983 | Close | 273/1.5 R |
| 4,465,277 | 8/1984 | Dittrich | 273/1.5 A |
| 4,526,367 | 7/1985 | Haston et al. | 273/1.5 R |
| 4,702,450 | 10/1987 | Barisa | 248/292.1 |
| 4,759,545 | 7/1988 | Grable | 273/1.5 R |
| 4,781,375 | 11/1988 | Nye | 273/1.5 R |
| 4,798,381 | 1/1989 | Dadekh | 273/1.5 R |
| 4,801,142 | 1/1989 | Friesen | 273/1.5 R |
| 4,941,661 | 7/1990 | Lykens | 273/1.5 R |
| 4,951,944 | 8/1990 | Morgan | 273/1.5 R |
| 5,133,547 | 7/1992 | Pardi | 273/1.5 R |

FOREIGN PATENT DOCUMENTS

| | | | |
|---|---|---|---|
| 681631 | 10/1966 | Belgium | 273/1.5 R |
| 6413102 | 5/1966 | Netherlands | 273/1.5 R |
| 908055 | 10/1962 | United Kingdom | 273/1.5 R |

*Primary Examiner*—Paul E. Shapiro
*Attorney, Agent, or Firm*—Barnes & Thornburg

[57] ABSTRACT

A height adjustable basketball backboard is pivotally attached to a support member by a parallelogram linkage. An adjusting link is a pivotally attached to an extension on one of the parallelogram links, is adjustably mounted to the support member and is weighted to act as a counter balance force to the weight of the basketball backboard to reduce the effort necessary to raise and lower the basketball backboard. A conversion kit for converting existing basketball backboard support system to the above referenced adjustable counter-weight design and methods for adjusting the counter-balance effect of the weight are disclosed.

21 Claims, 3 Drawing Sheets

20
23
22
26
24
12
16
18
28
30
23
24
34
38
14
22
36
46
44
46
42
48
40
47
43
10

22
16
28

36A
5
5
10

ADJUSTABLE BASKETBALL BACKBOARD SUPPORT SYSTEM

CROSS REFERENCE

This is a continuation-in-part of Ser. No. 07/889,124, filed May 27, 1992 now abandoned.

BACKGROUND AND SUMMARY OF THE INVENTION

The invention relates to an adjustable height basketball backboard support system wherein the basketball backboard is mounted to a support post through a parallelogram linkage and wherein a counter-weight is utilized to allow for easy raising and lowering the height of the basketball backboard.

The instant invention is a modification of the invention disclosed in a Design patent application Ser. No. 07/672,595 and Utility Patent application Ser. No. 07/888,652 of Timothy D. Hall which shows a counter-weight attached to a parallelogram linkage of an adjustable basketball backboard support system.

The instant invention differs from the above referenced disclosure in that in the instant invention the counter-weight and adjustment link used to change the height of the basketball backboard are the same member whereas the referenced disclosure attaches the counter-weight 10 to link 9 of the parallel linkage and provides a separate adjustable link 12 for adjusting the height of the basketball backboard.

Further, the instant invention contemplates providing a C-clamp collar support for attaching the adjustment link to the support post.

The invention also provides a handle for the adjustment link to facilitate holding of the basketball backboard while its height is adjusted.

Additionally the invention offers an adaption kit system to convert existing basketball backboard systems to support systems utilizing the adjustable counter-weight structure of the instant invention.

The invention contemplates several alternatives for the counter-weight system including but not exclusive to:

- a solid bar,
- a hollow cylinder filled with any of: sand, rocks, water, cement, etc.

The present invention contemplates methods of adjusting the counter-balance effect of the counter-weight. These include adjusting the pivotal connection of the combined adjustable link/counter-weight along an extension of the parallelogram linkage, adding weight at the pivotal connection, and adjusting the position of an additional counter-weight along an extension of the parallelogram linkage.

Other objects, advantages and novel features of the present invention will become apparent from the following detailed description of the invention when considered in conjunction with the accompanying drawings.

DETAILED DESCRIPTION OF THE INVENTION

Figure 1:
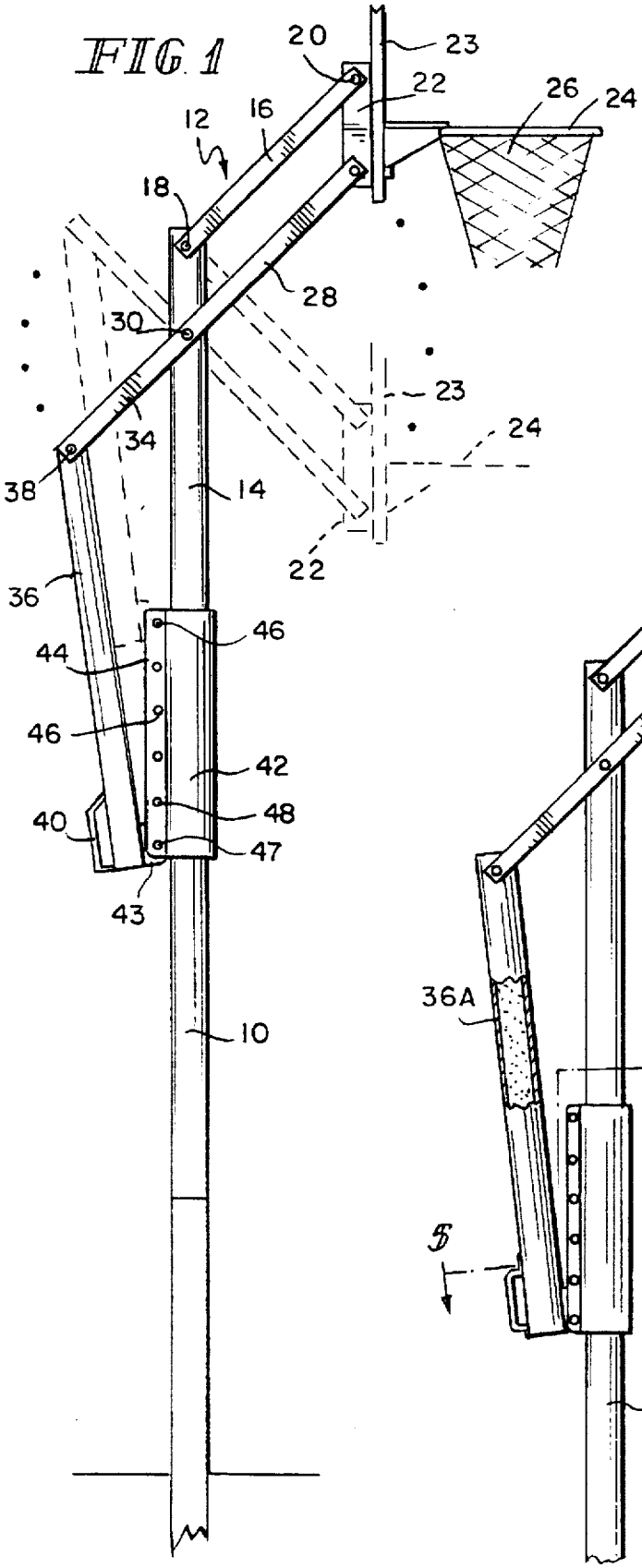
FIG. 1 shows a side view of the adjustable basketball backboard parallel linkage system with adjustable positions shown in dotted lines.

FIG. 1 shows a basketball support member 10 which can be mounted by sinking its lower end into the earth or a concrete footing. Alternatively the support member can be mounted on a portable mobile support platform (not shown) as is used in indoor basketball arenas, playgrounds or driveways. The support member 10 can be a round steel column, hollow post, I-beam or other structure which can rigidly support a basketball backboard.

The support post has a four bar parallelogram linkage system 12 attached thereto at its upper end 14. The parallelogram linkage system 12 includes two upper links 16 (only one of which can be seen in FIG. 1 as the second extends parallel and at the same angle therewith on the other side of the support member 10 and thus is hidden from view). The upper links 16 are attached to the upper end 14 of the support member 10 by a pivot rod or bolt 18 extending through the support member 10 and rotatably securing the upper links 16 to opposite sides of the support member 10. The two upper links 26 help reduce canting.

Outer ends of the upper links 16 are pivotally attached to a basketball backboard bracket 22 by pivot rods on bolts 20. A backboard 23, which has attached thereto a basketball rim 24 and net 26, is mounted to bracket 22. The rim 24 may be mounted to the backboard or directly to the bracket 22. Plural upper links 16 are utilized, one on each side of the support member 10, to keep the backboard 23 from canting with respect to the support member 10. While a single pivot element 18, 20 is utilized to attached the two upper links 16 to the support member 10 and to the backboard bracket 22, separate pivots for each upper link 16A and 16B could be provided such as shown for the lower links 28A and 28B in the modification of FIG. 4.

A pair of lower links 28 (only one of which can be seen in FIG. 1) are also provided and attached by pivot structures 30, 32 to two sides of the support member 10 and basketball backboard bracket 22, respectively. The two lower links 28 help reduce canting.

While two upper links 16 and two lower links 28 provide a good anti-canting support for the backboard 23, only one upper or lower link 16, 28 is necessary and a three link system is also contemplated utilizing a single upper link 16 with two lower links 28 or two upper links 16 and one lower link 28. Even a single lower and upper bar linkage is possible.

While the links 16 and 28 are shown attached to the basketball backboard bracket 22 directly they could as easily be directly attached to the rear of the backboard 23.

At least one and preferably both of the lower links 28 has an extension portion 34 thereon that extends past the pivot 30 to an opposite side of the support member 10 from the basketball backboard 23. Attached thereto by a pivot 38 is an adjustable counter-weight link 36.

Figure 2:
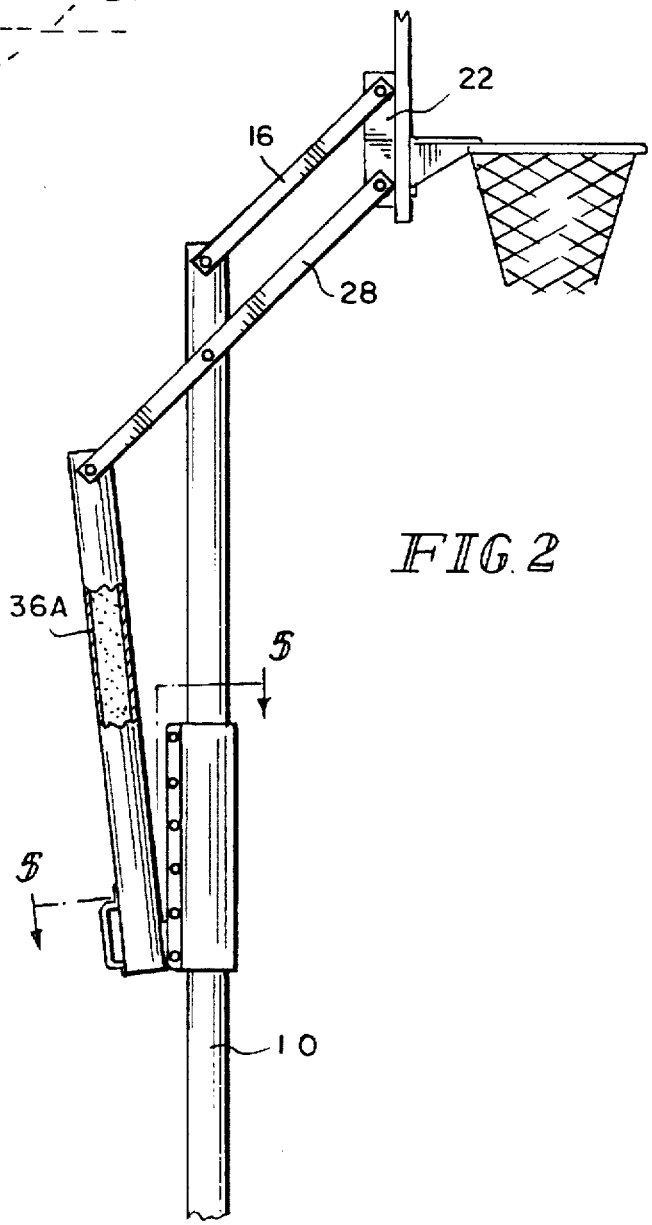
FIG. 2 shows a modification of the apparatus of FIG. 1 wherein the counter-weight adjustable linkage is formed from a hollow tube filled with ballast material.

This counter-weight link 36 can be a solid heavy bar 36 (FIG. 1) or a hollow tube 36A as shown in FIG. 2. The counter-weight 36 is of such weight as to provide a force tending to rotate the lower link 28 counter-clockwise to counter the weight of the backboard 23 tending to rotate the lower link 28 clockwise in the drawing. Ideally, the forces about pivot 30 due to the counter-weight link 36 and basketball backboard 23 should be close to equal but such is not mandatory. The purpose of the counter-weight concept is to make adjustment of the height of the backboard 23 easier as will be explained below. Where a hollow tube 36A filed with ballast is utilized (FIG. 2), it may be desirable to have the tube longer in length and/or wider in cross-section than the solid rod in order to compensate for the ballast weighing less than a solid rod.

The hollow tube 26A is closed at its bottom end and may be opened at its top end to receive the ballast. The ballast may include cement, sand or a liquid such as water or other available material. For sand or liquids, a cap may be used to cover the top end of the hollow tube 26A if consider necessary. The amount of ballast is determined by and adjusted to the weight of the backboard 23 and the parallelogram linkage system 12. The hollow tube 26A may be a sealed tube with a single inlet/outlet or a separate inlet and outlet for the introduction and removal of a liquid for adjustment of the counter balance weight. The inlet could be adapted to receive a garden hose.

Figure 5:
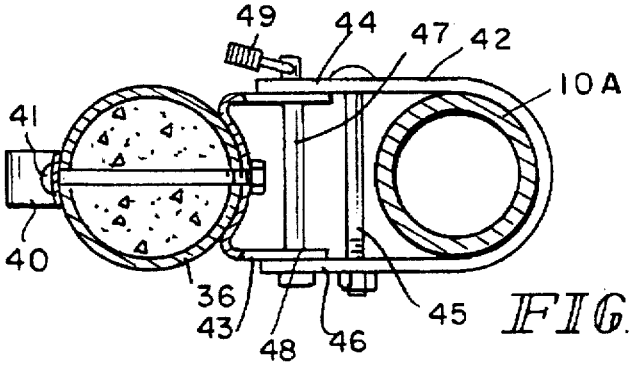
FIG. 5 shows a plan view of a C-clamp collar for attaching the adjustment link to a support post taken along lines 5—5 of FIG. 2.

A handle 40 is provided with a bracket 43 attached to the bottom of the counter-weight link 36 or directly thereto as by welding or bolting 41 (see FIG. 5). Attached to the support member 10 is an anchor illistrated as a C-clamp bracket 42. This bracket 42 can be welded, bolted 45 (see FIG. 5) or otherwise fixed to the support member 10 and is provided with extending lips 44 that have a plurality of height adjustment holes 46 thereon. A bracket 43 at the end of the counter-weight link 36 is attached to at least one of these holes 46 in lip 44 by a pin 47 to determine the height of the basketball backboard 22 by changing the angle of links 36, 28 and 16 with respect to the support member 10.

The handle 40 allows the adjustment link to be held and moved upward and downward with one hand while a second hand positions the pin 47 through a pair of holes 48 through bracket 43 and a selected pair of corresponding holes 46 in the lips 44 of bracket 42 to provide the correct height relationship between the ground and the basketball backboard 22. This connection via pin 47 can be provided with a padlock 49 assembly as shown in FIG. 5.

Figure 3:
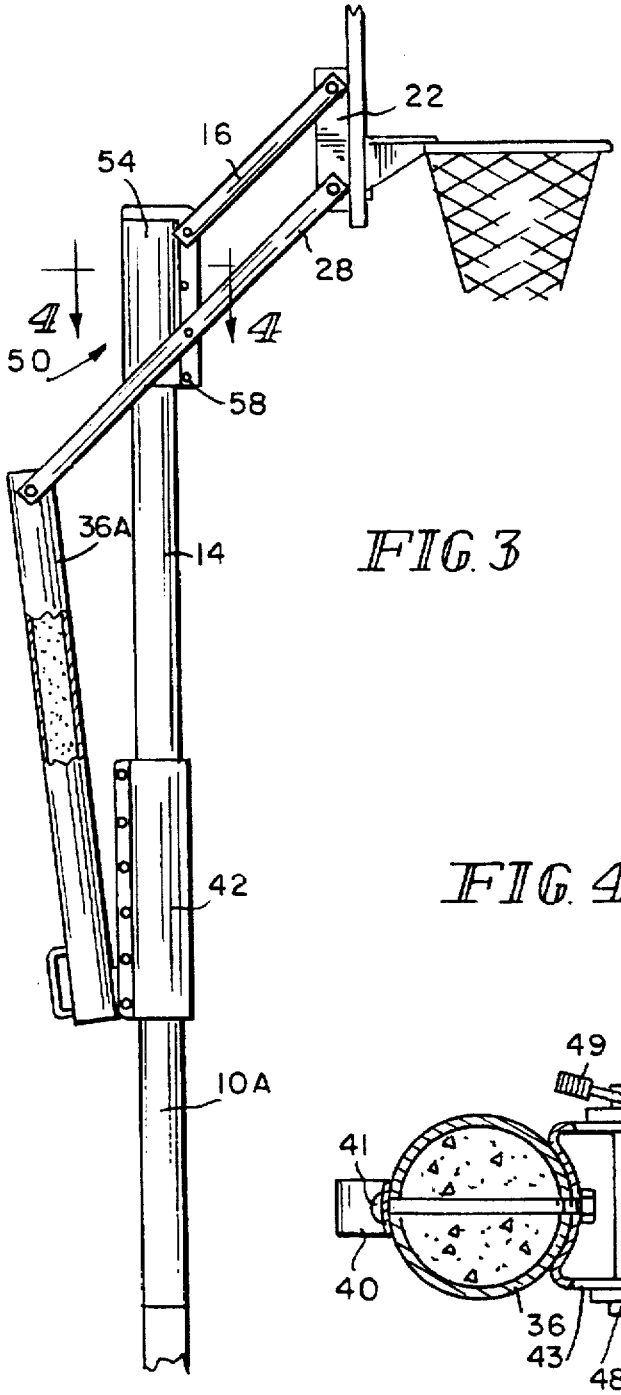
FIG. 3 shows another modification of the invention where a adaption kit is provided to convert another type of support system to the counter-weight parallelogram adjustable linkage system of the invention.
Figure 4:
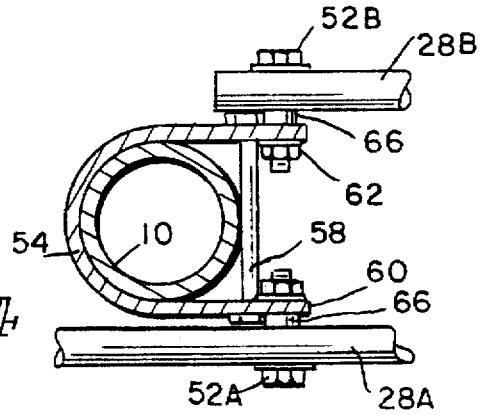
FIG. 4 shows a cross-section view of the adaption saddle taken along lines 4—4 of FIG. 3 which allows for conversion to the counter-weight parallel adjustable system of the invention.

FIGS. 3 and 4 show a conversion kit 50 which can be used to adapt an existing support pole 10A to the adjustable counterweight system of the invention. As seen in FIG. 4, the lower links 28A and 28B (which can be solid bars or tubes) are each pivoted by bolts 52A, 52B to a C-shape cap 54 surrounding the upper end 14 of the support member 10. A bolt 58 holds the C-shape cap to the support member 10. While the bolt 58 is shown attached to holes in protruding edges 60, 62 of the C-shape cap 50 to clamp the cap 50 to the support 10, it could of course extend through a hole in the support member 10 itself. The pivot bolts 52A and B are also attached to the protruding edges 60, 62 of the C-shape cap member 50. Thus, the parallelogram linkage system can be mounted to a support without drilling holes in the support member.

For greater stability against canting, spacers 66 of varying lengths can be utilized to separate further the distance between the lower links 28A and 28B.

The upper links 26 can likewise be attached to the C-shaped cap clamp 50 in a similar manner as the lower links 28A, 28B and can have different length spacers 66 than the lower links.

While the handle 40 is shown attached at the side of counter-weight link 40 it could be attached to its bottom.

Figure 6:
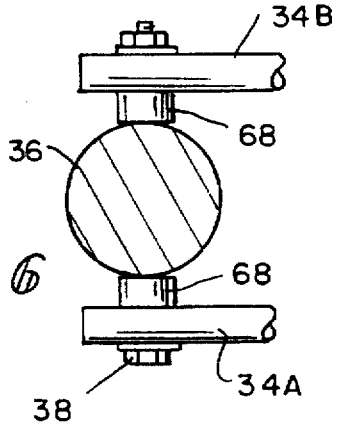
FIG. 6 shows a plan view of a first embodiment of a counter-weight adjustment method.

Another conversion kit would include an extension arm 34 to be attached to the lower arm of a standard parallelogram linkage system, the counter-balance link 36 and the anchor 42. Alternatively, the lower arms of the standard parallelogram linkage system could be replaced with the lower arms 28 which include the extension 34.

Where the counter-weight link 36 is a solid bar 36, it is designed for a specific weight backboard and parallelogram linkage system. If the backboard is purchase separately, some adjustment may be necessary. One method of adjustment is illustrated in FIG. 6, wherein the two lower links 28A,B both include extensions 34A,B separated from the bar 36 by spacers 68. The bar 36 would be designed for the minimum expected weigh backboard and the spacers 68 would be replaced by weights on pivot 38 to achieve the desired counter-balance.

Figure 7:
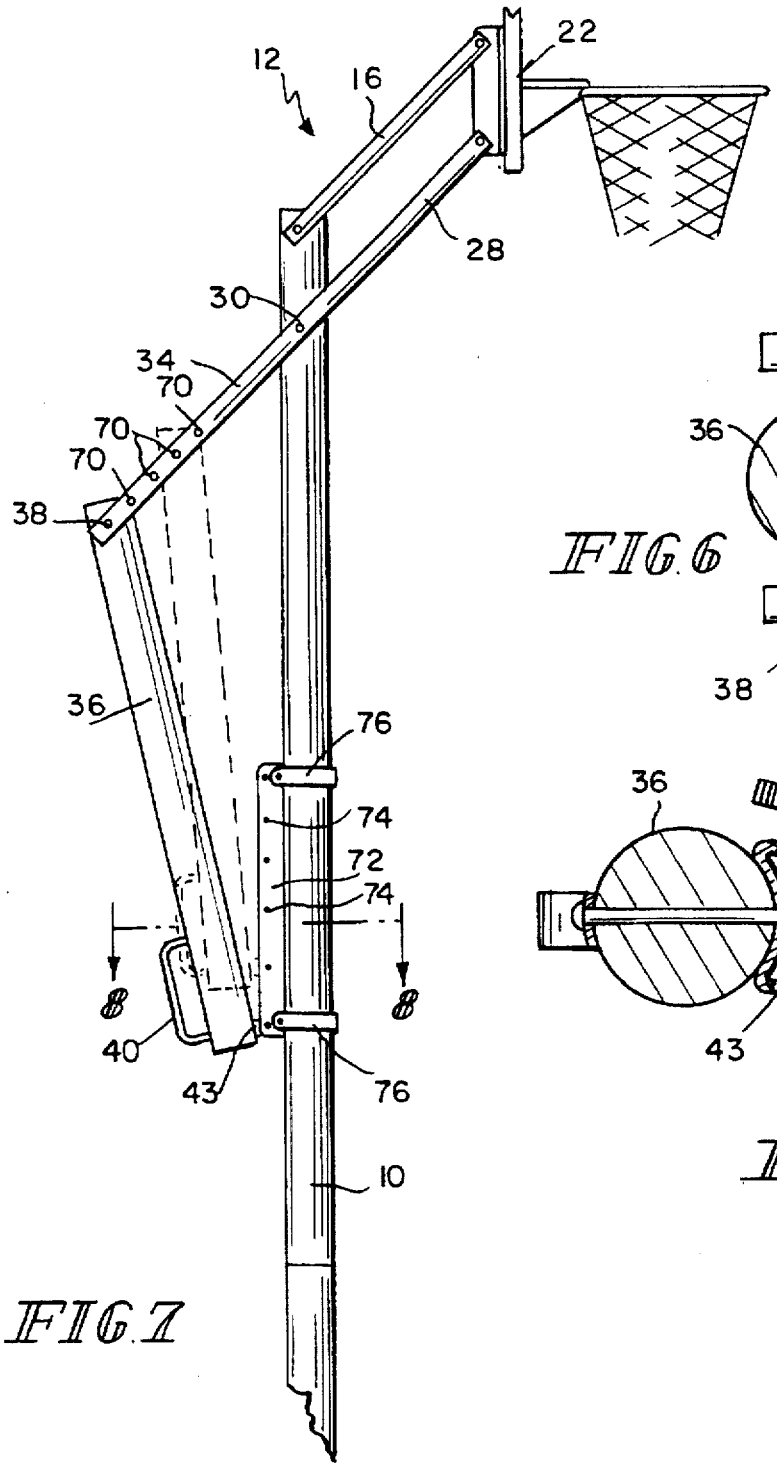
FIG. 7 shows a side view of a second embodiment of a counter-weight adjustment method.

Another method is illustrated in FIG. 7, wherein the extension 34 of the lower link 28 includes a plurality of holes 70 for the pivotal connection 38 of the bar 36 thereto. Adjusting this connection 38 changes the counter-balance effect of a fixed weight 36. Moving the connection 38 further away from the support 10, as shown in solid lines, increases the counter-balance effect. Conversely, moving the connection 38 closer to the support 10, as shown in dashed lines, decreases the counter-balance effect. Different holes 74 on an anchor 72 would correspond to the same height of the backboard depending on which hole 70 is used for the pivotal connection 38. More holes are provided on the anchor 72 to maintain the full range of height adjustment in combination with the weight adjustment then would be provided on the anchor 42.

As an even further method of adjustment would be to fix the location of the pivot 38 of the counter-weight link 36 and provided an additional counter-weight movably attached to the extension 34 of the lower links 28. The additional counter-weight may be secured by a pin in one of the holes 70 or may be secured by other well know devices to an extension without holes 70.

Although these methods of adjusting the counter-weight has been described with respect to the single extension of the parallelogram, they are also applicable to the systems where the counter-weight is on a different extension than the height adjustment mechanism as shown and described in the above mentioned Hall patent applications.

Figure 8:
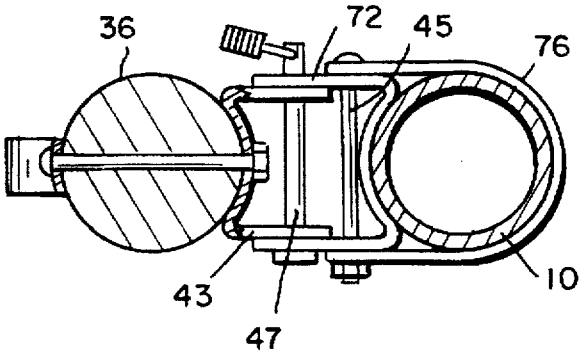
FIG. 8 shows a cross-sectional view of an anchor taken along line 8—8 of FIG. 7.

The anchor 72 of FIG. 7 is illustrated in detail in FIG. 8. The anchor has the same shape as the bracket 43 of the counter-weight link 36 and is mounted to the support member 10 by a pair of C-clamps 76. Pin 47 extends through aligned holes in anchor 72 and bracket 43 and bolt 45 extends through aligned holes in anchor 72 and C-clamp 76. Although the anchor 72 has been illustrated as being used with the weight adjustment of FIG. 7, it may also be used with the system of any other of the figures. Similarly, the anchor 42 may be used with the weight adjustment of FIG. 7.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An adjustable basketball backboard support system comprising:

a basketball backboard;

a support member;

a parallelogram linkage system including at least first and second parallel links pivotally interconnecting the basketball backboard and the support member;

adjustment means including an adjustment link for adjustably connecting said first link to said support member to determine the height of the basketball backboard; and wherein said adjustment link includes a counter-weight means for applying a primary force to said parallelogram linkage system in opposition to and substantially equal to a force applied to said parallelogram linkage system by the weight of the basketball backboard.

2. The system of claim 1, wherein:

said first link includes a first portion extending from said support member toward said backboard and a second portion extending from said support member away from said backboard; and said adjustment means is connected to said second portion of said first link.

3. The system of claim 1, wherein said counter-weight means includes varying means for adjusting said primary force applied by said counter-weight means.

4. The system of claim 3, said varying means varies the connection of said adjustment link to said first link to adjust said primary force applied by said counter-weight means.

5. The system of claim 1, wherein said adjustment link includes a solid section acting as said counter-weight means.

6. The system of claim 1, wherein said adjustment link includes a hollow section filled with a material acting as said counter-weight means.

7. The system of claim 6, wherein said material is cement.

8. The system of claim 6, wherein said material is sand.

9. The system of claim 6, wherein said material is a liquid.

10. The system of claim 1, wherein said adjustment means includes a handle for facilitating holding of said basketball backboard while adjusting a position of said first link to the support member.

11. The system of claim 1, wherein:

said linkage system includes a bracket mounted to said support member; and said first and second links are pivotally connected to said bracket.

12. An adjustable basketball backboard support system for mounting a basketball backboard to a support member comprising:

a parallelogram linkage system including at least two parallel links for pivotally interconnecting the basketball backboard and the support member;

a bracket for mounting said linkage system to said support member;

adjustment means for adjustably connecting one of said links to said support member to determine the height of the basketball backboard;

said adjustment means including a clamp to be mounted to said support member and said clamp having a plurality of holes defining a plurality of heights of said backboard and a pin adjustably attaching said adjustment means to said clamp at one of said holes; and a counter-weight means connected to one of said links for applying a first force to said parallelogram linkage system in opposition to a second force to be applied to said parallelogram linkage system by the weight of the basketball backboard.

13. The system of claim 12, wherein said adjustment means includes a handle for facilitating holding of said backboard while adjusting the securement of the adjustment means by the pin.

14. The system of claim 12, wherein said counter-weight means includes varying means for adjusting said first force applied by said counter-weight means.

15. The system of claim 14, wherein:

said adjustment means includes an adjustment link for interconnecting a first one of said links to said clamp;

said adjustment link includes said counter-weight means; and said varying means varies the connection of said adjustment link to said first link to adjust said first force applied by said counter-weight means.

16. The system of claim 12, wherein:

said adjustment means includes an adjustment link for interconnecting one of said links and said clamp; and said adjustment link includes a solid section acting as said counter-weight means.

17. The system of claim 12, wherein:

said adjustment means includes an adjustment link for interconnecting one of said links and said clamp; and said adjustment link includes a hollow section filled with a material acting as said counter-weight means.

18. An adjustable basketball backboard support system for mounting a basketball backboard to a support member comprising:

a parallelogram linkage system including at least first and second parallel links for pivotally interconnecting the basketball backboard and the support member;

adjustment means for adjustably connecting said first link to said support member to determine the height of the basketball backboard;

a counter-weight means including a mass on said adjustment means for applying a first force to said parallelogram linkage system in opposition to a second force to be applied to said parallelogram linkage system by the weight of the basketball backboard; and varying means for adjusting the connection of said adjustment means to said first link to vary said first force applied by said mass.

19. The system of claim 18, wherein:

a first link includes a plurality of holes; and said varying means includes a pin for varying the connection of said adjustment means to one of laid holes in said first link to adjust said first force applied by said mass.

20. The system of claim 18, wherein:

said adjustment means includes an adjustment link for interconnecting said first link and said support member;

said adjustment link includes said mass; and said varying means varies the connection of said adjustment link to said one link to adjust said first force applied by said mass.

21. An adjustable basketball backboard support system comprising:

a basketball backboard;

a support member;

a parallelogram linkage system including at least two parallel links pivotally interconnecting the basketball backboard and the support member;

adjustment means for adjustably connecting one of said links to said support member to determine the height of the basketball backboard; and said adjustment means including a C clamp attached to said support member and having a plurality of holes defining a plurality of heights of said backboard and including a pin adjustably attaching said adjustment means to the clamp at one of said holes.

* * * * *